US006108936A

United States Patent [19]

Vuorinen

[11] Patent Number: 6,108,936

[45] Date of Patent: Aug. 29, 2000

[54] METHOD AND DEVICE FOR CONTACT-FREE DRYING OF A PAPER WEB OR EQUIVALENT

[75] Inventor: Vesa Vuorinen, Turku, Finland

[73] Assignee: Valmet Corporation, Finland

[21] Appl. No.: 09/220,628

[22] Filed: Dec. 24, 1998

Related U.S. Application Data

[63] Continuation of application No. PCT/FI97/00387, Jun. 18, 1997.

[30] Foreign Application Priority Data

Jun. 24, 1996 [FI] Finland ..... 962607

[51] Int. Cl.[7] ..... F26B 7/00

[52] U.S. Cl. ..... 34/425; 34/460; 34/465; 34/115; 34/119; 34/122

[58] Field of Search ..... 34/422, 425, 460, 34/465, 115, 116, 117, 119, 122, 124

[56] References Cited

U.S. PATENT DOCUMENTS

| | | | |
|---|---|---|---|
| 2,736,106 | 2/1956 | Offen | 34/642 |
| 3,279,091 | 10/1966 | Freuler | 34/642 |
| 3,962,799 | 6/1976 | Lapointe et al. | 34/570 |
| 4,297,794 | 11/1981 | Luthi | 34/115 |
| 4,980,979 | 1/1991 | Wedel | 34/458 |
| 5,135,614 | 8/1992 | Aula et al. | 162/217 |
| 5,199,623 | 4/1993 | Rajala et al. | 242/615.12 |
| 5,397,438 | 3/1995 | Nyberg et al. | 162/207 |
| 5,575,084 | 11/1996 | Vuorinen | 34/460 |

FOREIGN PATENT DOCUMENTS

| | | |
|---|---|---|
| 0238470 | 9/1987 | European Pat. Off. . |
| 64335 | 11/1982 | Finland . |
| 468217 | 3/1990 | Sweden . |
| 463568 | 11/1990 | Sweden . |

OTHER PUBLICATIONS

PCT, World Intellectual Property Org., W/O 90/14467, Nov. 1990.

*Primary Examiner*—Pamela A. Wilson
*Attorney, Agent, or Firm*—Steinberg & Raskin, P.C.

[57] ABSTRACT

Method for one of drying and cooling a web in which a web is passed over an arcuate circumference of a blow device, a gas is directed from an interior of the blow device at the web through first openings formed in a mantle of the device to form a support zone between the mantle and the web, and moistened exhaust gas is drawn from the support zone into the interior of the blow device through second openings formed in the mantle. A revolving edge support is arranged at each end of the blow device to support the web during the passage of the web over the circumference of the blow device, the edge supports being separate from the blow device, and the edge supports include one of interior circumferential and friction surfaces to seal the support zone. A device for one of drying and cooling a web includes an elongate blow device having a circumference over which the web is guided to run, intake and exhaust ducts arranged in an interior of the blow device and a mantle including first openings in flow communication with the intake duct and second openings in flow communication with the exhaust duct. The device also includes a revolving edge support arranged at each end of the blow device for supporting and guiding the web during running of the web over the circumference of the blow device, the edge supports being separate from the blow device, and support constructions for supporting the blow device in a stationary position.

20 Claims, 14 Drawing Sheets

METHOD AND DEVICE FOR CONTACT-FREE DRYING OF A PAPER WEB OR EQUIVALENT

CROSS-REFERENCE TO RELATED APPLICATION

This application is a continuation of International Application PCT/FI97/00387 filed Jun. 18, 1997.

FIELD OF THE INVENTION

The present invention relates to a method for drying and/or cooling a web, in which the web is passed over the circumference of a blow drum or equivalent blow device and dried by means of a pressurized drying gas that is blown out of openings formed in the mantle of the blow drum into a gap between an outer face of the blow drum and the web. A support zone is formed by the pressurized gas between the outer face of the blow drum and the web. Gas moistened with water evaporated from the web is passed out of the support zone into the interior of the blow drum through other openings formed in the mantle of the blow drum into a set of exhaust ducts placed at least partially inside the blow drum.

The present invention also relates to a device for drying and/or cooling a web including a blow drum or equivalent blow device. The web to be dried is guided over the circumference of the blow drum. In the interior of the blow drum, a system of gas ducts has been formed and communicates with blow openings formed into the mantle of the blow drum. A support zone is formed by pressurized gas between the outer face of the blow drum and the web to be dried. Exhaust openings are formed in the mantle of the blow drum for removal of the moistened gas out of the support zone.

BACKGROUND OF THE INVENTION

The highest web speeds in paper machines are currently of an order of about 25 meters per second, but before long, a speed range of from about 25 m/s to about 40 m/s is likely to be taken into use. Even with the highest running speeds that are employed now, and with the ever higher running speeds in the future, the dryer section has become and will likely remain a bottle-neck for the runnability of a paper machine.

In the prior art, in multi-cylinder dryers of paper machines, twin-wire draw and/or single-wire draw is/are employed. In twin-wire draw, the groups of drying cylinders comprise two wires which press the web, one from above and the other one from below, against heated faces of drying cylinders. Between the rows of cylinders, which are usually horizontal rows, the web has free and unsupported draws which are susceptible to fluttering which may result in web breaks. In single-wire draw, each group of drying cylinders comprises only one drying wire on whose support the web runs through the entire group so that, on the drying cylinders, the drying wire presses the web against the heated cylinder faces, and on the reversing cylinders situated between the drying cylinders, the web remains at the side of the outside curve. Thus, in single-wire draw, the drying cylinders are placed outside the wire loop, and the reversing cylinders are placed inside the wire loop. In prior art "normal" groups with single-wire draw, the heated drying cylinders are placed in the upper row, and the reversing cylinders are placed in the lower row, these rows generally being horizontal and parallel to one another. So-called "inverted" groups with single-wire draw are also known, in which the heated drying cylinders are placed in the lower row and the reversing suction cylinders or rolls in the upper row, the substantial objective of such inverted groups being to dry the web from the side opposite in relation to the side of the web dried in a normal group with single-wire draw.

In the area of the dryer section of a paper machine, various problems have occurred, for which the present invention suggests novel efficient solutions. These problems include the large length of the dryer section which increases the costs of the dryer section and the machine hall. It is not desirable to enlarge the diameter of drying cylinders in order to increase the capacity because the drying cylinder is basically a pressure vessel and large rotating masses create problems. Problems have also been caused by the difference in speed between the paper web and the wires, which has resulted in wear of the wires and, at the worst, even in paper breaks in the dryer section. Problems also have occurred in the controllability of the web draw and in the runnability of the web. The cross-direction shrinkage which deteriorates the quality of the paper or board, has also been a problem, especially when the cross-direction shrinkage is uneven.

With respect to the prior art related to the present invention, reference is made, for example, to the following publications.

Swedish Patent No. 463,568 (corresponding to International Publication No. 90/14467) describes a method for drying paper in a paper machine by means of which cross-direction shrinkage of the paper web is influenced and favorably prevented in a paper machine comprising at least one heated drying cylinder and at least one drying wire. In the paper machine, the paper web is passed over the drying cylinder in direct contact with its cylinder face at the same time as the drying wire is passed from outside onto the paper web, wherein the longitudinal edges of the paper web are drawn or sucked into contact with one or more cylinders while the web is carried around these cylinders. Thus, in the construction described in this patent, suction is used in connection with the drying cylinder, and the web to be dried is in a direct contact with the face of the drying cylinder. Also, the paper web is supported by the cylinder face over its entire width while the paper web is running over the drying cylinders.

European Patent No. 0 238 470 describes a device in the dryer section of a paper machine, preferably in the dryer section of a cylinder dryer, which device permits control of shrinkage and/or stretch of the paper web in the cross direction of the web in relation to the running direction of the dryer section. The device includes belts, most commonly two belts, which extend or run through the whole dryer section or a part of it and which belts are arranged in the lateral area of the paper web so that they distribute the force that is directed perpendicularly to the running direction of the web and mainly acts in the lateral areas of the paper web. The belt and/or the paper web is coated with an adhesive layer from the side of the web/belt that is placed towards the paper web/belt, in which case, the belt and the paper web act upon each other. In the arrangement described in EP '470, the paper web is attached by its edges to a separate support belt, which support belt is aligned with a groove arranged on the circumference of the cylinder.

Swedish Patent No. 468,217 describes a carrying device for passing the stock web through the dryer section of a paper machine. In the device, carrying belts are arranged on both sides of the stock web in its edge areas in the longitudinal direction, which carrying belts are passed onto rolls, operated by guide members, and grasp corresponding grooves arranged on the rolls, so that shrinkage in the cross direction is prevented. The guide members of each dryer belt comprise a number of individual guides that are placed in pairs above and below the carrier belt and the stock web. In an arrangement in accordance with SE '217, paper is attached from its edges by means of two mechanical chains, and this arrangement is meant for very slow running speeds only.

Finnish Patent Application No. 895928 (corresponding to U.S. Pat. No. 5,135,614) describes a suction roll in which the paper web adheres to the face of the suction roll over its whole width, and an intensified hold is arranged in the lateral areas of the suction roll. The suction roll comprises a perforated roll mantle and a suction space inside the roll mantle which can be subjected to a vacuum. A suction flow thus enters through the perforations in the roll into the roll interior and the paper web is pressed towards the outer face of the roll mantle. The suction space is divided at least into three vacuum spaces in the direction of width of the roll, while the suction space comprises at least two partition walls inside the roll. By means of the partition walls, the suction roll is divided into different vacuum zones such that it is possible to provide the outer vacuum spaces with a higher vacuum than the vacuum space in the mid area of the roll, whereby the vacuum profile is arranged to be growing towards the edges of the roll across the width of the roll and the percentage of shrinkage in the lateral areas of the paper web is reduced, which has a favorable effect on the evenness of the shrinkage.

Finnish Patent No. 84088 (corresponding to U.S. Pat. No. 5,397,438) describes a method in the transfer of a paper web for reducing and equalizing the cross-direction shrinkage of the paper web in the dryer section of a paper machine. The drying wire is provided, in its lateral areas, with an adhesive substance for the time of the process, in which connection, by means of adhesion means, an adhesion force is produced in the drying stage between the lateral areas of the wire and the paper, whereby cross-direction shrinkage of the paper web is prevented. The adhesive substance is removed when it is no longer needed.

U.S. Pat. No. 4,980,979 describes a suction roll whose function is to provide at least one end of the roll with a higher vacuum level than the rest of the roll in order to make threading of the web easier and which suction roll thus has a function corresponding to that described in Finnish Patent Application No. 895928.

With further respect to the prior art, reference is made to Finnish Patents Nos. 64,335 and 82,019 (corresponding to U.S. Pat. No. 5,199,623) which describe arrangements in which a support wire is not used, but the web is carried by an airborne nozzle blowing.

With respect to additional prior art closely related to the present invention, reference is made to the current assignee's Finnish Patent Application No. 943040 (corresponding to U.S. Pat. No. 5,575,084) which describes a method and device for drying and cooling a paper web or equivalent. In the method, for drying and cooling the paper web or equivalent, the web is passed over the circumference of a revolving roll or equivalent on support of a support wire or equivalent on the face of the support wire or equivalent that is placed facing the roll, and the web is dried and/or cooled by means of a gas. It has been considered one novelty of this method that drying and/or cooling gas is blown through openings formed in the mantle of the roll into the space between the outer face of the roll and the web supported by the support wire or equivalent, whereby a support zone formed by pressurized gas is formed between the outer face of the roll and the web. Moistened or humidified gas is passed out of the support zone into the interior of the roll through exhaust openings formed in the mantle of the roll, and more specifically into a system of ducts placed inside the roll.

OBJECTS AND SUMMARY OF THE INVENTION

An object of the present invention is further development of the above web drying and/or cooling constructions.

Another object of the present invention is to provide a web drying and/or cooling arrangement and method in which problems connected with the cross-direction shrinkage of the paper web are taken into consideration in the drying of the paper web.

A further object of the invention is development of the web drying and/or cooling constructions and methods described above so that the diameter of the drying drum does not impose limitations, but can be freely selected, as well as so that the geometry of the dryer group formed by means of the drying drums can be selected freely without deterioration of the efficiency.

Another object of the invention is further development of the above web drying and/or cooling constructions and methods so that the drying can be arranged only on the part of the drying drum that is covered by the material to be dried as well as so that it is possible to use a so-called geometry of inverted group.

A further object of the invention is further development of the above web drying and/or cooling constructions and methods so that the proportion of revolving masses in the dryer group is minimized.

An additional object of the invention is to develop the prior art web drying and/or cooling constructions and methods so that the construction is simple and easy to build and, additionally, so that the drying of the paper web can be made as uniform as possible.

In view of achieving the objects stated above and others, in the method in accordance with the invention, the web to be dried is supported in the lateral areas by means of a revolving edge support placed at each end of the blow drum and which is separate from the blow drum, and a support zone is sealed in the running direction of the web by means of the circumferential faces and/or friction faces of the edge supports.

The device in accordance with the invention comprises revolving edge supports arranged in connection with the ends of the blow drum, apart from the blow drum. The revolving edge supports are arranged to support and guide the web to be dried. The blow drum is arranged stationarily in its position by means of support constructions.

Thus, by means of the arrangement in accordance with the invention, a contact-free mode of drying supported by the edges is provided, in which mode of drying the material web runs supported by an air cushion. In such an arrangement, it is possible to use high temperatures and the geometry of the dryer group can be selected freely, because the efficiency is not lowered. The height of the air cushion is selected suitable for the edge supports by means of the ratio of blow air to exhaust air, and the support of the edges can be made more effective by subjecting the circumferential and/or friction faces of the edge supports to a vacuum. Thus, suction is used in the effective section only.

In the arrangement in accordance with the invention, only the edges of the web and/or the support band are supported, and the support zone, i.e., air cushion, is formed between the stationary nozzle face of the drum and the web. In this arrangement, air circulation can be arranged either through the nip opening or through the ends. In the arrangement in accordance with the invention, only the edge supports revolve, sealing the support zone at the same time, and they are mounted in bearings outside the blow area and isolated from the blow area, in which case, it is possible to use blow air having a high temperature.

Very good possibilities for control of cross-direction shrinkage which takes place during drying of the paper web or a corresponding web-like material are achieved by means of an arrangement in accordance with the invention, because the outer circumferences of the equipment can easily be arranged to increase the hold at the edge and, additionally, if required, cooling can be arranged in them, and the mid-part and the ends of the drying drum can be isolated from each other. The edges are supported by means of a vacuum, in which case, a direct blowing or an airborne nozzle blow can be applied onto the face of the web material to be dried, and the pressure of the supporting air cushion can be selected by means of the pressure ratio of the blow air to the exhaust air into/out of the blow drum. If necessary, the blow openings in the blow drum can be provided with suitable nozzles, in which case, a suitable distance is achieved between the blow drum and the web material to be dried. Additionally, the coverage angle on the drying drum can be selected as desired in accordance with the rest of the geometry of the group.

It is possible to use the device in accordance with the invention either as provided with a support band or without a band.

In one exemplifying embodiment of the invention, it is possible to divide the blow drum into blocks or sections in the longitudinal direction of the web, in which case, the temperature of the blow air can be regulated in the zones in the longitudinal direction of the web. Additionally, the stationary blow drum can be divided into blocks, in which case, it is possible to regulate the profile, the speed and the temperature of the blowings.

Additionally, in the arrangement in accordance with the invention, the type of the nozzles can be selected in accordance with the grade of the paper or board and thus, the thickness and strength factors of paper or board can be taken into account, such as, for example, dry solids content, porosity, etc. The blow face of the drum can be divided into different temperature areas by using division of the drum into zones in the longitudinal direction and in the cross direction of the web, in which case, it is also possible to regulate the web profile both in the longitudinal direction and in the cross direction. In an arrangement in accordance with the invention, the edge supports operate as sealing faces for the air cushion, and the mid-area of the drum may be isolated from the lateral areas. In this manner, for example, mounting in bearings and corresponding arrangements can be carried out in ordinary conditions, and the temperature and moisture circumstances otherwise influential in the drying, need not be taken into account when choosing the arrangements. The edge supports can be provided with cooling if necessary. In view of energy consumption, direct gas heating is the most advantageous application for the heating of the drying drum in accordance with the invention. Naturally, other alternatives occurring to a person skilled in the art are also within the scope of the invention.

In the arrangement in accordance with the invention, a difference in pressure may be brought about over the web-like material, and the thickness of the support zone, i.e., air cushion, is selected in compliance with the distance of the circumference of the edge supports, i.e., the equivalent diameter. Since, by means of the edge support, an additional support has been created in the lateral areas of the web to be dried, the rest of the web to be dried can be equalized easily while drying and, thus, cross-direction shrinkage of the web can be controlled and especially any tensions that may follow from such shrinkage are eliminated. In the arrangement in accordance with the invention, roughening of the circumference of the edge supports, formation of grooves or other friction enhancing element can be used as additional support, if required, and this can be enhanced further by subjecting the friction faces to a vacuum.

In the arrangement in accordance with the invention, the web can also be spread by arranging the circular edge support faces to open in the direction of progress of the web. The spreading effect is based on the fact that the web can be stretched also in the cross direction in the dry solids content area in which it is stretched (drawn) in the longitudinal direction. The opening angle of the edge supports can be made adjustable such that the extent of the stretch can be regulated by means of the opening angle. When a support wire is used in connection with the web, the edges of the support wire are arranged penetrable to air so that the vacuum effect produced by the arrangement is not transferred to the wire. At a higher dry solids content, the opening angle of the edge supports can be used to maintain the existing web width, for example, to eliminate the shrinkage of the web in free gaps. By means of spreading of the web, it is possible to affect the uniformity of quality in the product in respect of factors of strength, to improve the runnability, and/or to increase the production.

The invention will be described in detail with reference to some preferred embodiments of the invention illustrated in the figures in the accompanying drawings. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which:

FIGS. 1A, 1B, 1C, 1D, 1E and 1F are schematic illustrations of an exemplifying embodiment of the invention, in which FIG. 1A is a schematic sectional view in the longitudinal direction of the drum, FIGS. 1B and 1C are schematic sectional views in the cross direction of the drum taken along the lines 1B—1B, 1C—1C, respectively, of FIG. 1A, FIG. 1D is a schematic view taken in the direction of arrows 1A in FIG. 1A, FIG. 1E is a schematic three-dimensional illustration of the drum in accordance with the invention, and FIG. 1F is a schematic illustration of an exemplifying embodiment of the nozzle arrangement of the blow drum;

DETAILED DESCRIPTION OF THE PREFERRED EMBODIMENTS

Figure 1A:
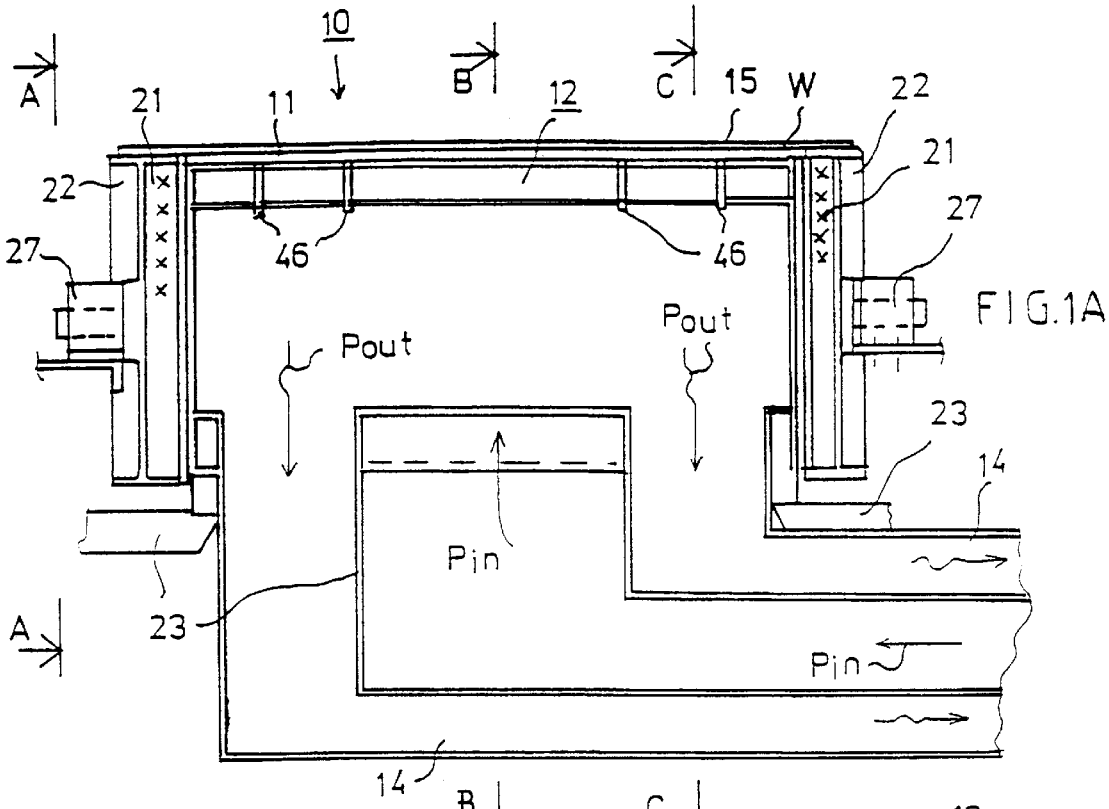

Referring to the accompanying drawings wherein like reference numerals refer to the same or similar elements, the blow device in accordance with the invention shown in FIGS. 1A–1E is designated 10 and is this embodiment, is in the form of a drum 10 having a mantle 12 provided with intake or blow holes 44 and exhaust holes 46. Holes 44 and 46 are also referred to as openings herein. Drying gas $P_{in}$, which is typically heated air, is passed into the drum 10 and blown through the holes 44 at the surface of the web-like material W to be dried, for example a paper web. In this exemplifying embodiment of the invention, the web W is supported by a support band or wire 15 so that a positive pressure is formed between the outer face of the drum 10 and the web W. By means of a suitable blow pressure, the web W is separated from the face of the drum 10. The separation of the web W from the face of the drum 10 permits the flow of the drying gas from the intake holes 44 to a support zone or air cushion 11 and from the air cushion 11 into the exhaust holes 46, and the drying process proper is thus able to take place via these gas flows. More particularly, with a suitable blow pressure, which pressure depends on the force that the support band 15 applies to the web W, i.e., on the tension of the wire, a support zone consisting of pressurized gas, the so-called air cushion 11, is formed between the outer face of the drum 10 and the web W supported by the wire 15, which air cushion 11 carries and dries the web. The blown gas/air is dry and heated and, thus, able to increase its humidity or bind humidity. The blow speed of the drying gas is from about 20 meters per second to about 150 meters per second, preferably from about 40 meters per second to about 120 meters per second, and the temperature of the drying gas during drying is from about 30° C. to about 450° C., preferably from about 70° C. to about 350° C.

The humid gas resulting from the drying of the web W is removed from the support zone 11 through the exhaust holes 46 arranged between the blow holes 44. Additionally, it is possible to use direct-blow nozzles that blow perpendicularly toward the web or, for example, a pressure nozzle technique as shown in FIG. 1F, in which case, the blowing takes place through slot nozzles and the exhaust passages are between the slots. The rest of the face of the drum 10 aside from the gas flow holes 44,46 can be smooth or grooved. The grooves can be placed in the longitudinal or cross direction to the mantle of the drum 10 or in between these, i.e., along a diagonal. The grooves can also be radial in relation to the inflow holes 44 and exhaust holes 46. The drying gas $P_{in}$ is passed through the intake duct 13 and through the holes 44 in the mantle 12 face of the drum 10 into the space between the outer face of the drum 10 and the web W, into which zone, the air cushion 11 is thus formed. The exhaust hoes 46 are arranged between the intake holes 44 and through the exhaust holes, the gas that has bound the humidity from the web W is removed through one or more exhaust ducts 14 arranged at least partially in the interior of the drum 10. The web W is passed while supported by the wire 15 over an alignment roll 61 onto the face of the drying drum 10 and away from the drum 10 over another alignment roll 61.

In FIG. 1A, the rotating edge support is denoted by reference numeral 22, and the outer circumference of the edge support forms, together with the support band 15, sealing faces for the support zone, i.e., for the air cushion 11. The edge supports 22, which are separate from the drum 10 and isolated therefrom by isolation members 21, revolve around an axle 27 thus drawing the support band 15 around the arcuate circumference of the drum 10. The blow drum 10 is mounted stationary by means of support structures 23. Additionally, the intake and exhaust ducts 13,14 can function as support members for the drum 10. The air-intake and exhaust-air arrangements can also be placed so that the ducts 13,14 pass through the ends of the drum 10.

Figure 1B:
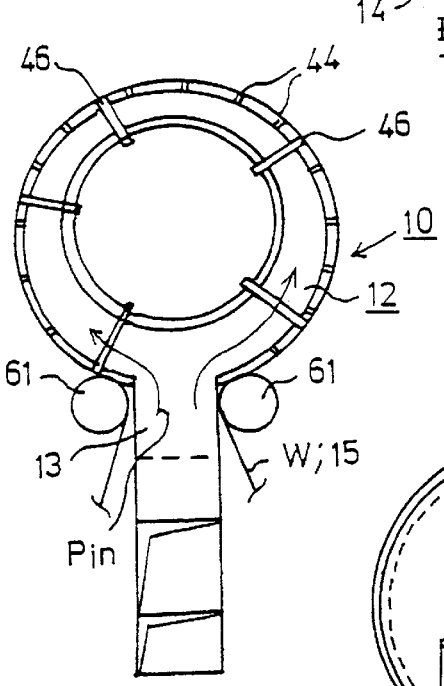

FIG. 1B is a schematic sectional view taken along the line 1B—1B in FIG. 1A, in which sectional view the alignment or guide rolls 61 are shown. By means of guide rolls 61, the web W to be dried and the support band 15 are passed around the drum 10 and away from the drum 10. As shown in FIG. 1B, the intake air flow $P_{in}$ is passed in the intake duct 13 into the interior of the drum 10, and from the interior of the drum 10 through the blow holes 44 to the area of the support zone or air cushion 11. Exhaust air is removed through the exhaust holes 46.

Figure 1C:
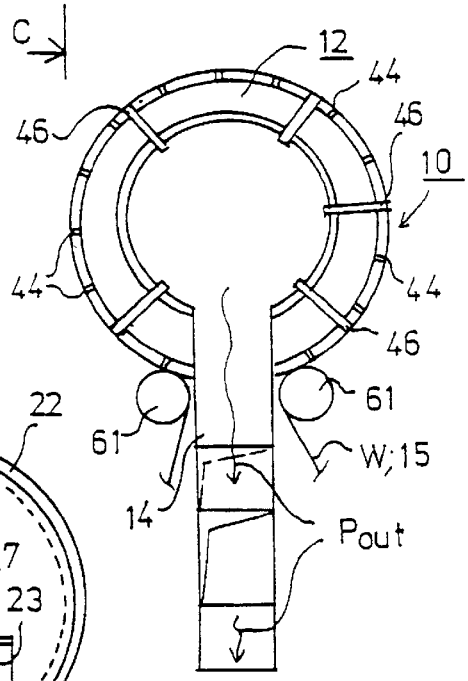

In FIG. 1C, in the sectional view taken along the line 1C—1C in FIG. 1A, the exhaust air duct 14 of the blow drum 10 is shown, through which the exhaust air coming from the holes 46 is passed out of the drum 10 interior as an exhaust air flow $P_{out}$.

Figure 1D:
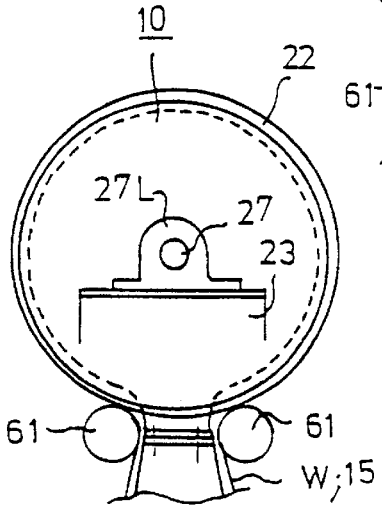

FIG. 1D is an end view seen in the direction of arrows 1A in FIG. 1A, in which the edge supports 22 of the drum 10 and the axle 27 of the supports are shown. Axle 27 is arranged to revolve on a bearing 27L mounted on the support constructions 23. The diameter of the drum is indicated by a dashed line.

Figure 1E:
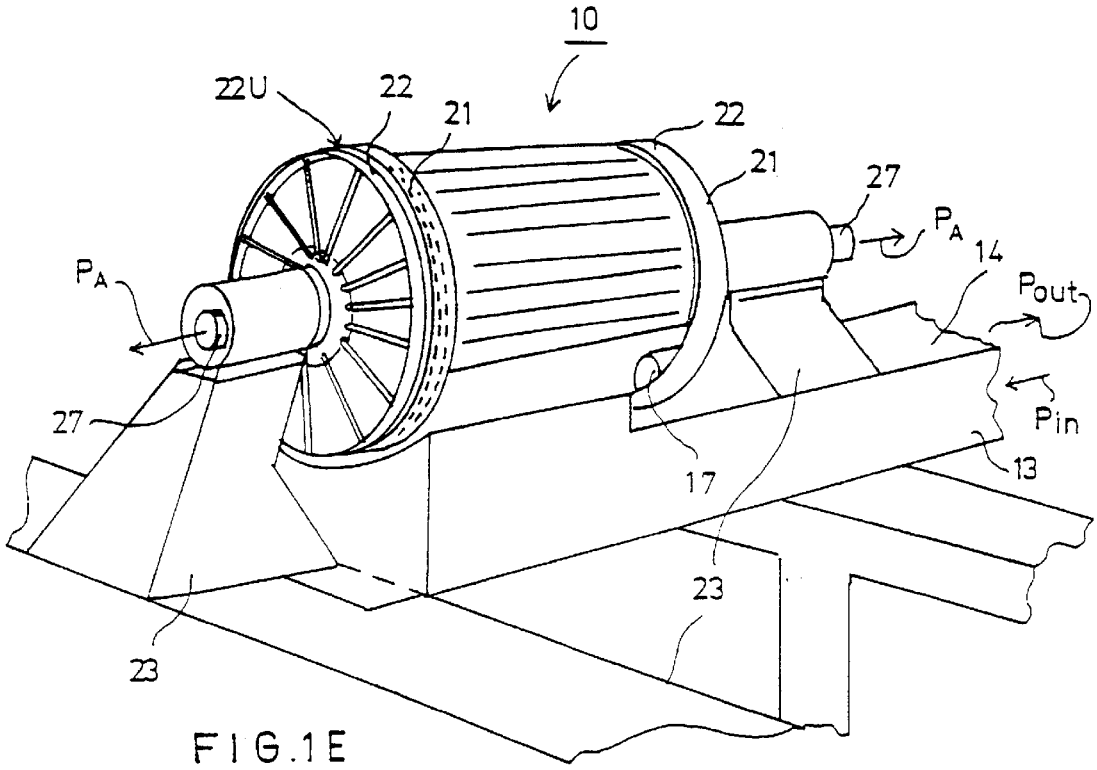
Figure 1F:
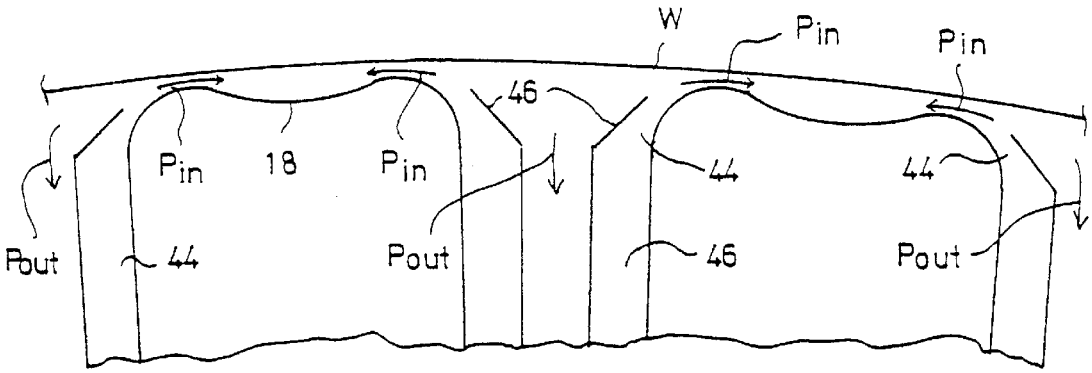

As shown in FIG. 1E, the edge supports 22 of the blow drum 10 revolve around the axle 27. At the same time the edge supports 22 seal the air system. A groove 22U for the threading ropes is arranged in connection with the edge support 22 at one end for threading of the web. Suction PA is applied through the axles 27 to enhance the hold of the web produced by the edge supports 22. Isolation members 21 may be arranged in connection with the edge support 22. The area between the edge supports 22 of the blow drum 10, in which area, the air cushion 11 is formed, has a positive pressure of about from 0 Pa to about 5000 Pa. In FIG. 1E, the support constructions of the drum 10 are denoted generally by reference numeral 23, and the air intake duct 13 and the exhaust air duct 14 are shown. A groove 17 or equivalent can be arranged in the drum 10 to permit passage of any paper lumps, i.e., clods, that may be carried along by the web to be dried.

FIG. 1F shows an arrangement for the nozzle arrangement of the blow drum 10 in which a nozzle face 18 formed on the face of the drum 10 is curved so that it passes air from the intake openings 44 to the support zone. On the other hand, the faces passing to the exhaust openings or holes 46 are constructed to guide the exhaust air flow $P_{out}$ into the duct 46 and further into the exhaust duct 14 (see, e.g., FIG. 1E).

Figure 2A:
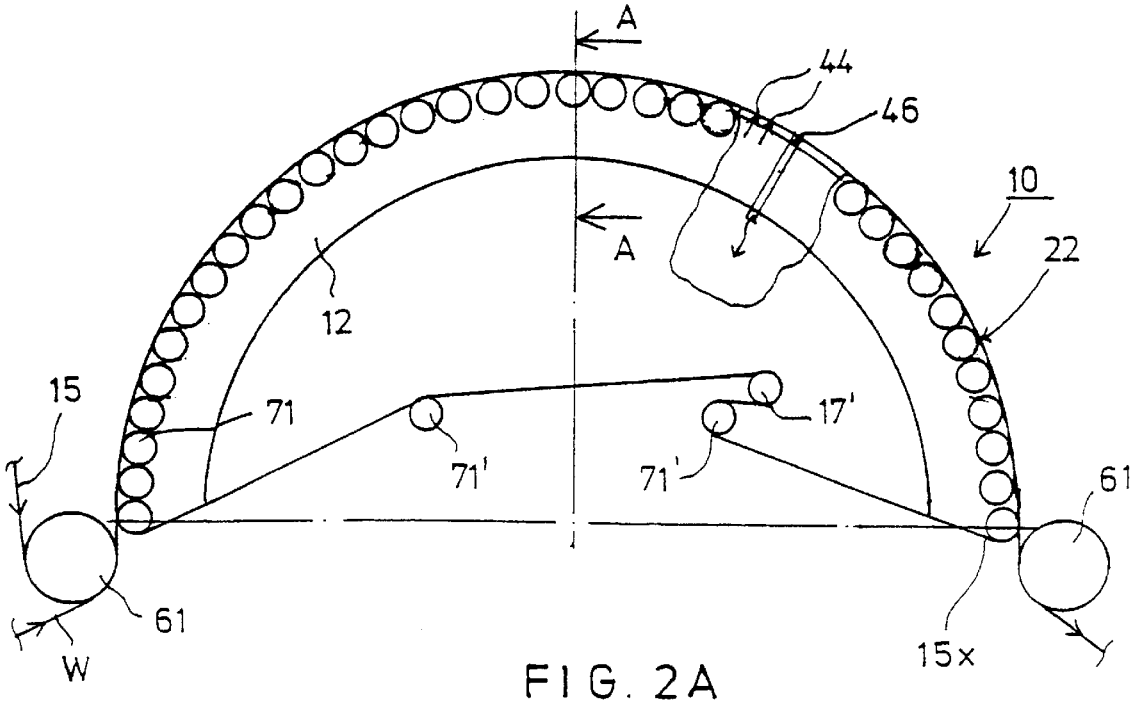
FIGS. 2A and 2B are schematic illustrations of a second exemplifying embodiment of the invention.
Figure 2B:
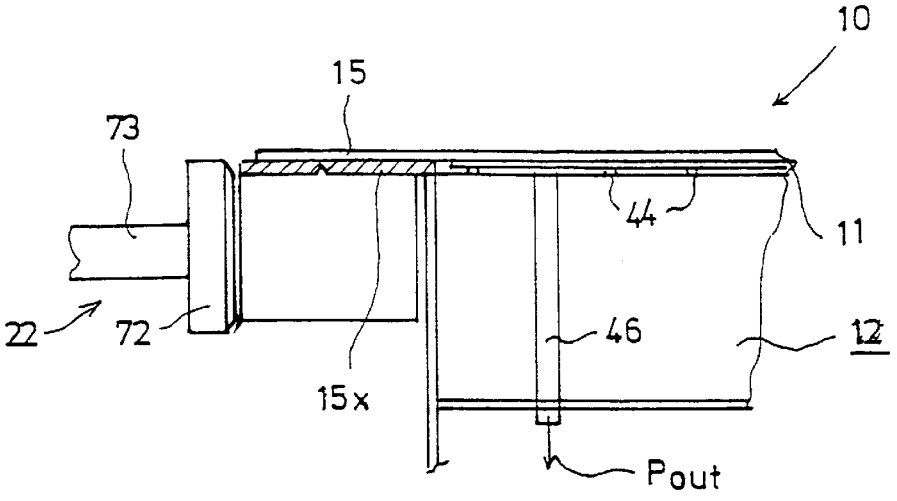

In the exemplifying embodiment of the invention shown in FIGS. 2A and 2B, the blow device 10 is formed so that several guide rolls or wheels 71 are arranged in connection with the mantle 12 of the drum 10 so that they form edge supports 22 that have the shape of an arc of a circle. A support band 15*x* runs around each set of guide rolls or wheels 71 and around additional guide rolls or wheels 71' which enable the support band 15*x* to form a closed loop around the guide rolls or wheels 71. The web W to be dried is passed via the guide rolls 61 over the arc of a circle formed by the guide rolls or wheels 71. Air is blown to the air support zone or cushion 11 through the blow holes 44 formed in the mantle 12, which air support zone is formed between the support bands 15*x* and the wire 15, so that the air serves to dry the paper web W or equivalent. The edges of the wire 15 are supported by the support bands 15*x* which are placed on the revolving guide and axle parts 72,73.

Figure 3:
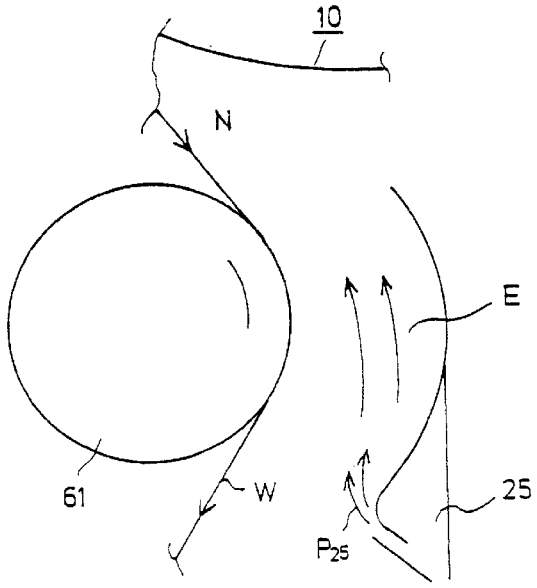
FIG. 3 schematically shows a mode of sealing the nip between the drum and the guide roll.

FIG. 3 shows a safety gap E arranged between the blow device 10 and the guide rolls 61, and it schematically shows a method of sealing the nip N between the drum 10 and the guide roll 61, into which nip the web W is passed supported by the wire. A blow device 25 is placed in the nip area, by means of which a sealing blow $P_{25}$ is blown in a direction opposite to the running direction of the support fabric and the web W to thereby seal the nip.

Figure 4:
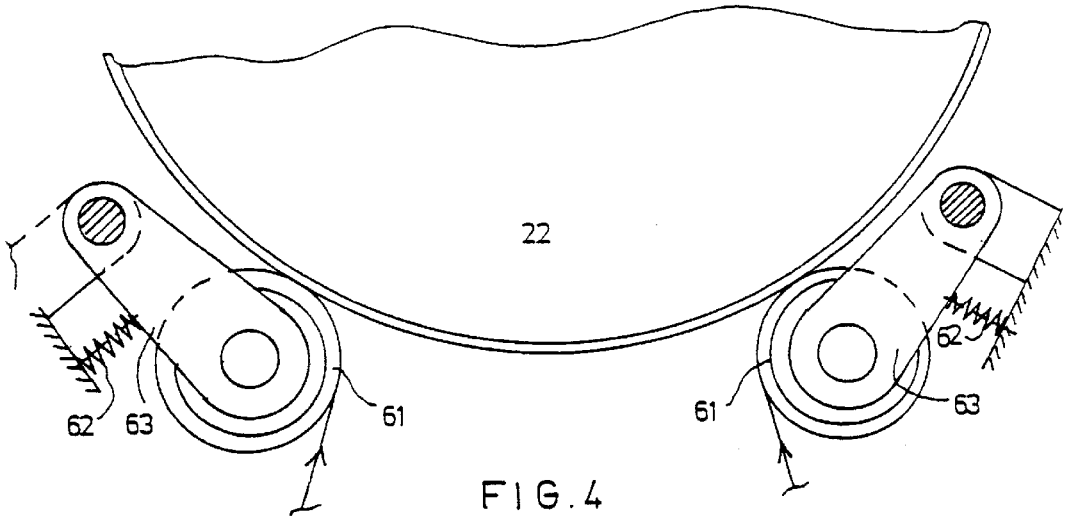
FIG. 4 schematically shows an embodiment in which the guide rolls in contact with the drum are displaceable.

FIG. 4 schematically shows an embodiment in which the guide rolls 61 of the edge support 22 are each displaceable by means of a spring 62 connected with an arm 63.

Figure 5A:
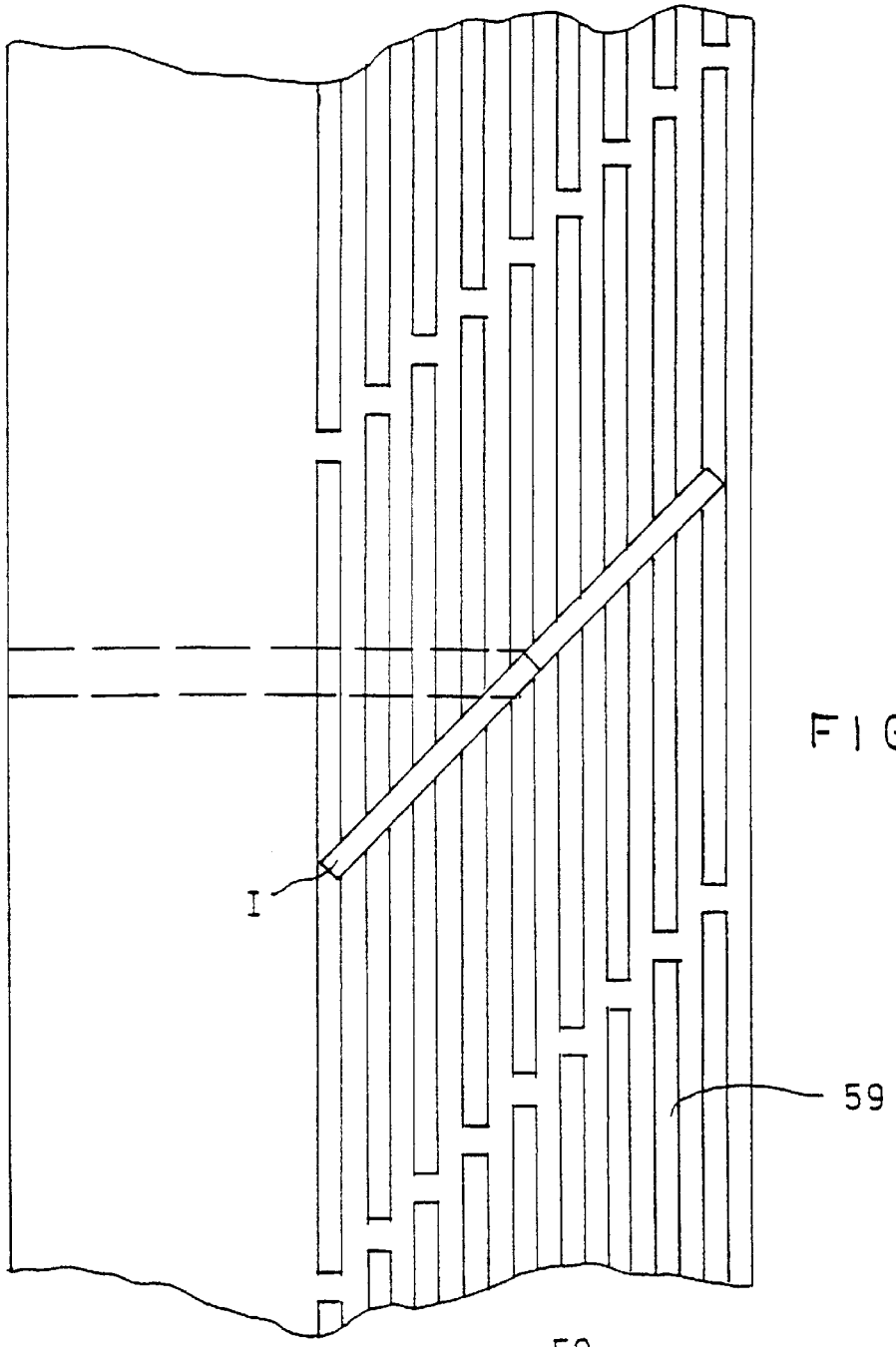
FIGS. 5A and 5B schematically show an embodiment of a friction face provided on the circumference of the edge support.
Figure 5B:
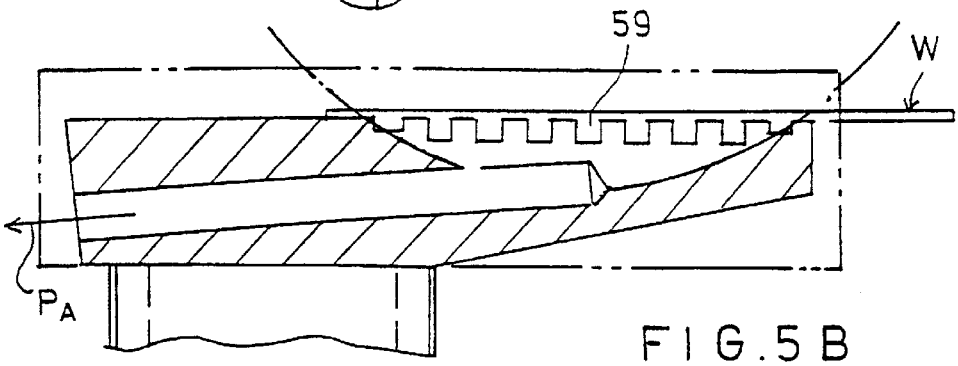

FIGS. 5A and 5B schematically show an embodiment in which suction is applied to the area of the edge supports 22. The hold of the web W is arranged by means of grooves 59 on the edge supports. The reference I refers to one suction sector, and reference arrow PA refers to the vacuum/suction produced. FIGS. 5A and 5B show an embodiment of the friction face on the circumference of the edge support 22. The grooves 59 can be subjected to a vacuum through the passage and the form of a parallelogram in the grooving eliminates any discontinuity in the friction face.

Figure 5C:
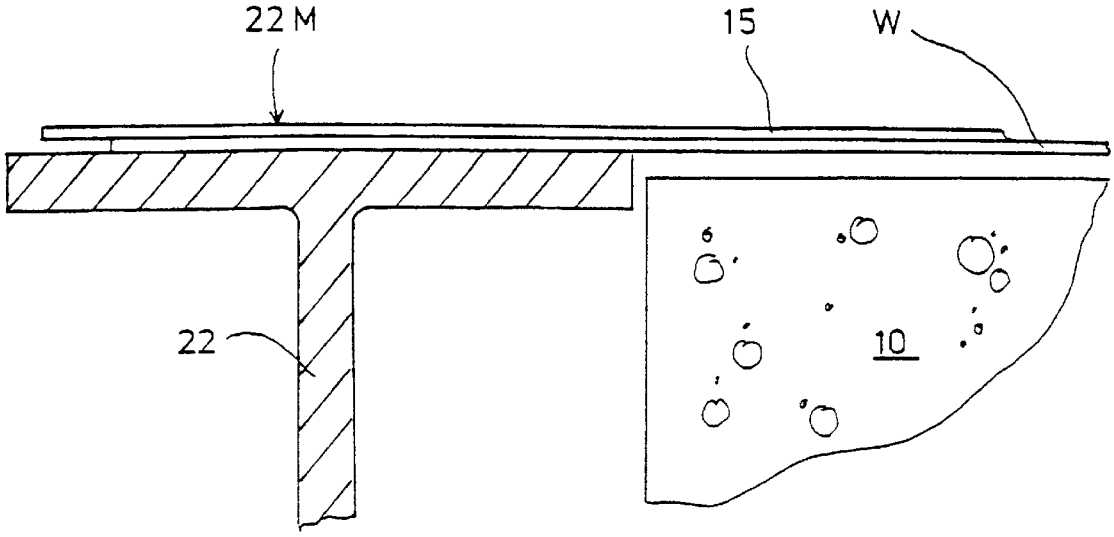
FIGS. 5C, 5D, 5E, 5F, 5G and 5H show different modes of arrangement of the edge support of the web and/or support band.

FIG. 5C shows an embodiment of the blow drum 10 with a support band 15, in which embodiment, the grip of the web W on the edge support 22 can be adjusted by the tightness of the support band 15 (tightness force 22M).

Figure 5D:
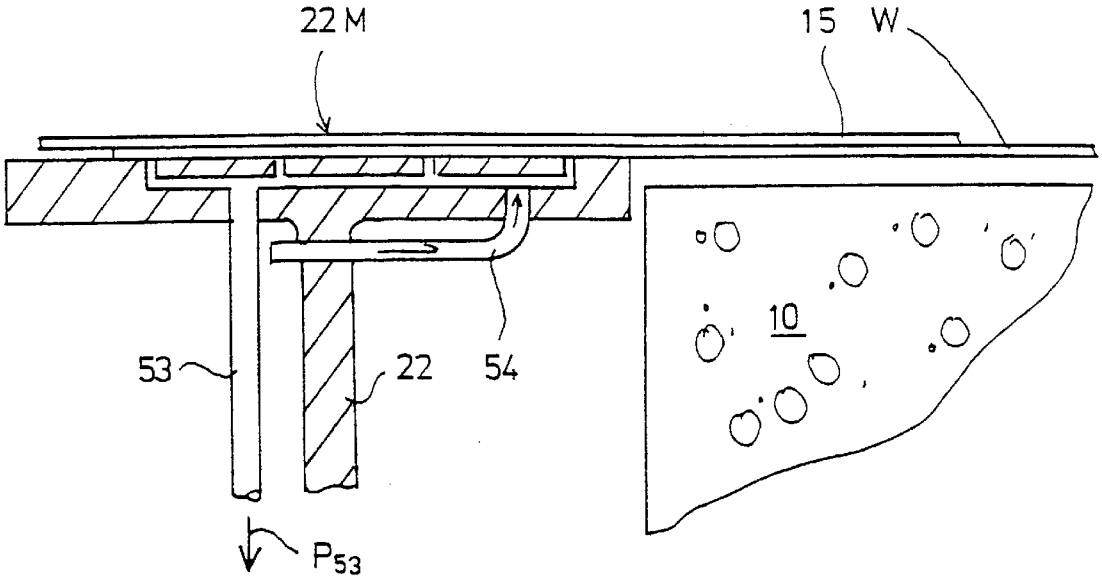

In the embodiment shown in FIG. 5D, the grip of the web W on the edge support 22 is made more effective by means of a vacuum via ducts 53. Cooling of the edge of the support band 15 can be carried out by cooling the edge supports 22, for example, by means of air. Through the duct 54, for example, outside air is passed into the duct 54 made inside the edge support 22 so that the edge of the support band 15 can be cooled. The cooling medium may be other than air, for example liquid or some other gas.

Figure 5E:
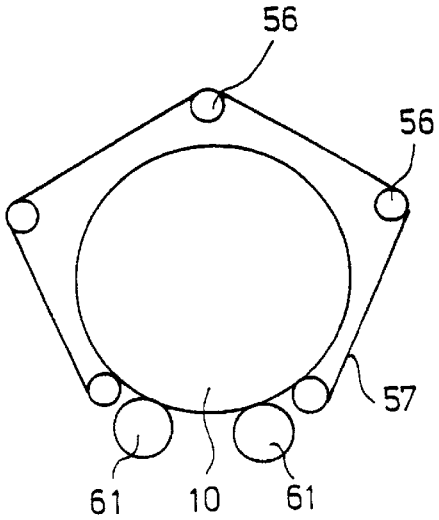
Figure 5F:
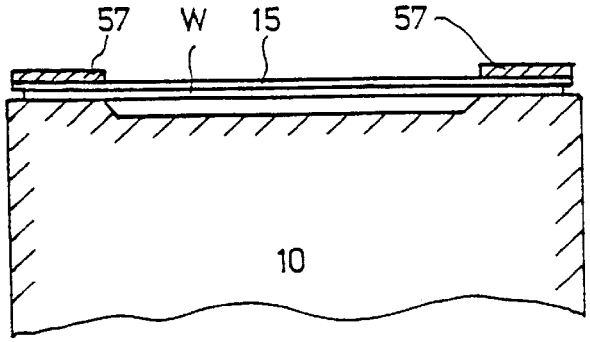

In the embodiment shown in FIGS. 5E and 5F, edges of the support band 15 or the web W are supported on the circumference of the edge supports 22 by means of separate loop bands 57 running over the band 15 so that the band 15 is between the loop bands 57 and the blow device 10. The tension of the support bands 15 is adjusted by means of displaceable guide rolls or wheels 56.

Figure 5G:
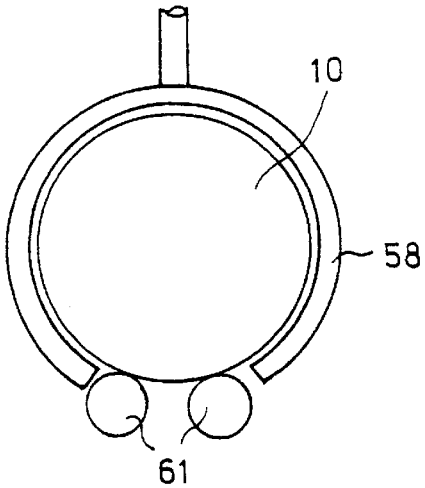
Figure 5H:
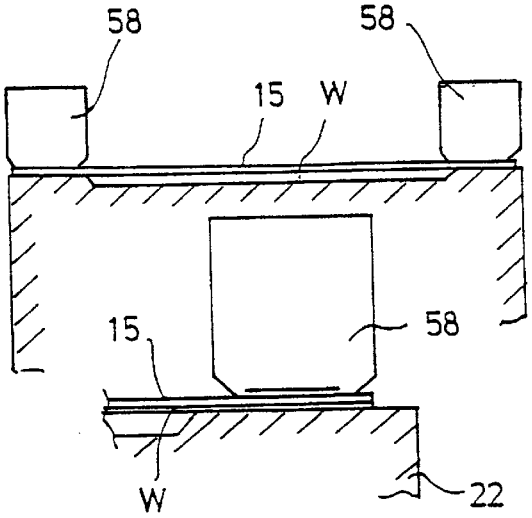

FIGS. 5G and 5H show the support of the edges of the support band 15 or the web W against the circumference of the edge supports 22 by means of the blow boxes 58. By means of blow boxes 58, a backup support effect is created, whose hold effect consists of the blow pressure multiplied by the desired surface area.

Figure 5I:
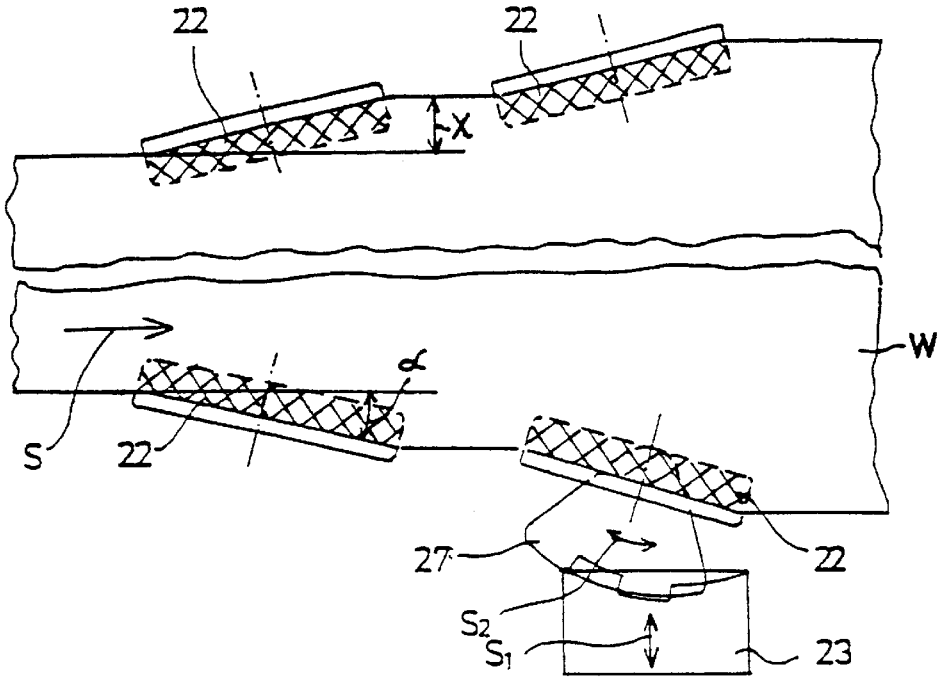
FIG. 5I schematically shows the edge supports that open in the direction of progress of the web.

FIG. 5I schematically shows the edge supports 22 that open in the direction of progress S of the web W, viewed from above. At a suitable dry solids content of the web W, it is possible to install the edge supports 22 opening in the direction of progress S of the web W, in which case the web W can be stretched in the cross direction. The ratio of the spreading per side to the opening angle is $\tan \alpha = x/2/D$ wherein $\alpha$ is the opening angle and D is the diameter of the edge support 22, in which connection the distance that the web runs during spreading is $x = \pi \cdot D/2$. A number of such units made out of edge supports 22 can be arranged one after the other, in which connection passing of the web W from one unit to the other takes place, for example, by means of a turning roll. The opening angle $\alpha$ of the edge support 22 is preferably adjustable, for example by adjusting the turning angle of the shaft 27 in the direction of the arrow $S_2$ and by moving the frame construction 23 in the direction indicated by the arrow $S_1$. When a support wire is used, its edges must be penetrable to air, so that the vacuum effect does not pass to the wire.

Figure 6:
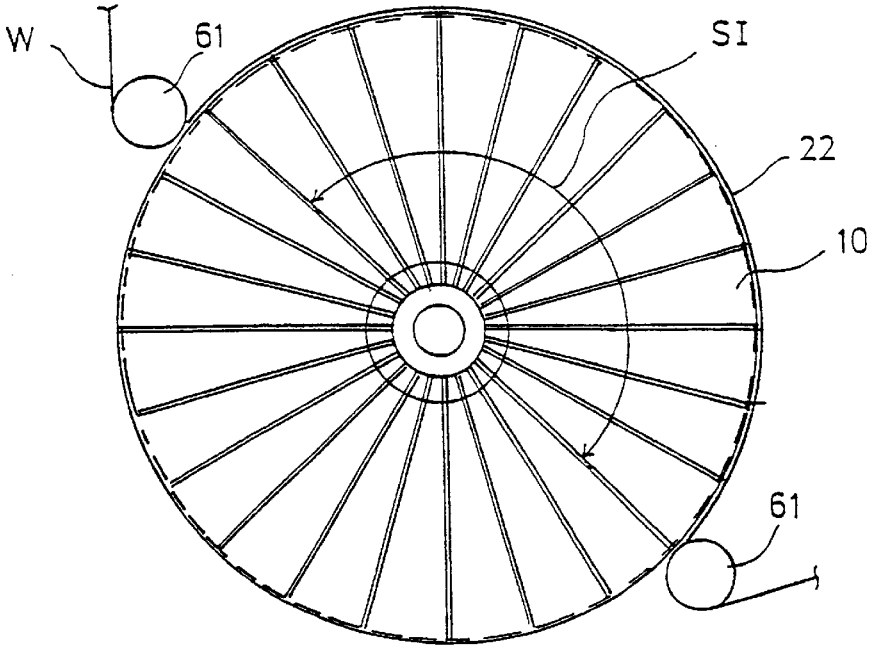
FIG. 6 schematically shows a sector suction arrangement arranged in connection with the edge support of the blow drum in accordance with the invention.

FIG. 6 schematically shows the sector-suction area SI of the edge supports 22, in which sector-suction area the suction effect may be arranged in the desired sector area SI on the circumference of the edge supports 22. In such a case, the web W to be dried is passed from the guide roll 61 over the sector SI and further away from the guide roll 61. The sector area SI may be any desired length, i.e., so that it comprises a certain number of circumferential sectors, and the guide rolls 61 may be shifted to the desired location.

Figure 7A:
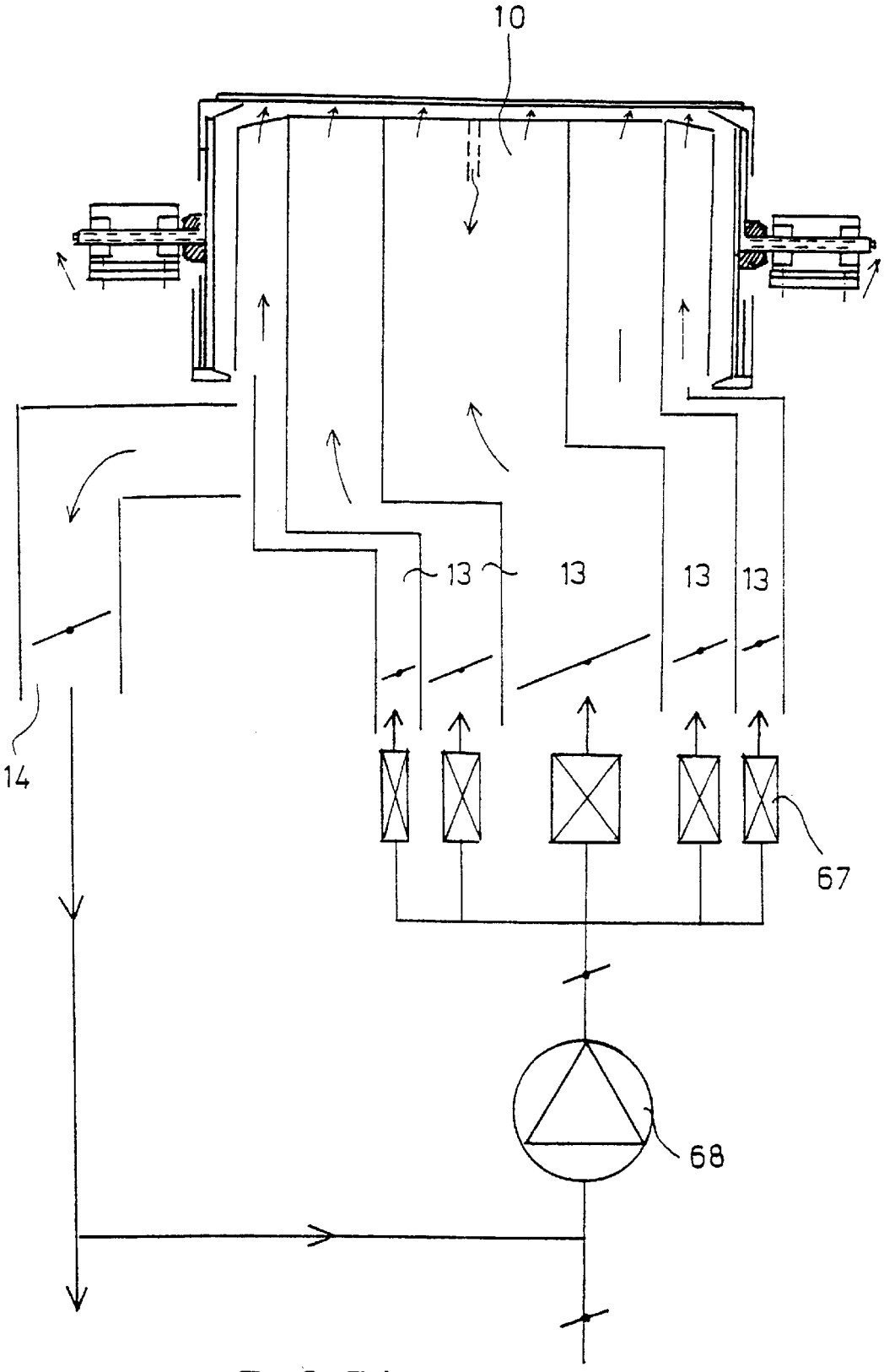
FIGS. 7A and 7B schematically show examples of regulation arrangements for use with the invention for regulation of the temperature and the blow pressure in connection with the cross-direction profile of the drum and/or with the zone division of the drum in the longitudinal direction.

FIG. 7A is a schematic illustration of an exemplifying embodiment including separate temperature regulation of the cross-direction profile and/or longitudinal segment division. The blow device 10 is partitioned into discrete cross-direction or axial sections, each extending over a portion of the longitudinal axis of the blow device. The segments on the stationary drum 10 are each provided with their own heat sources 67, into which heat sources the air is passed by means of a common blower 68.

Figure 7B:
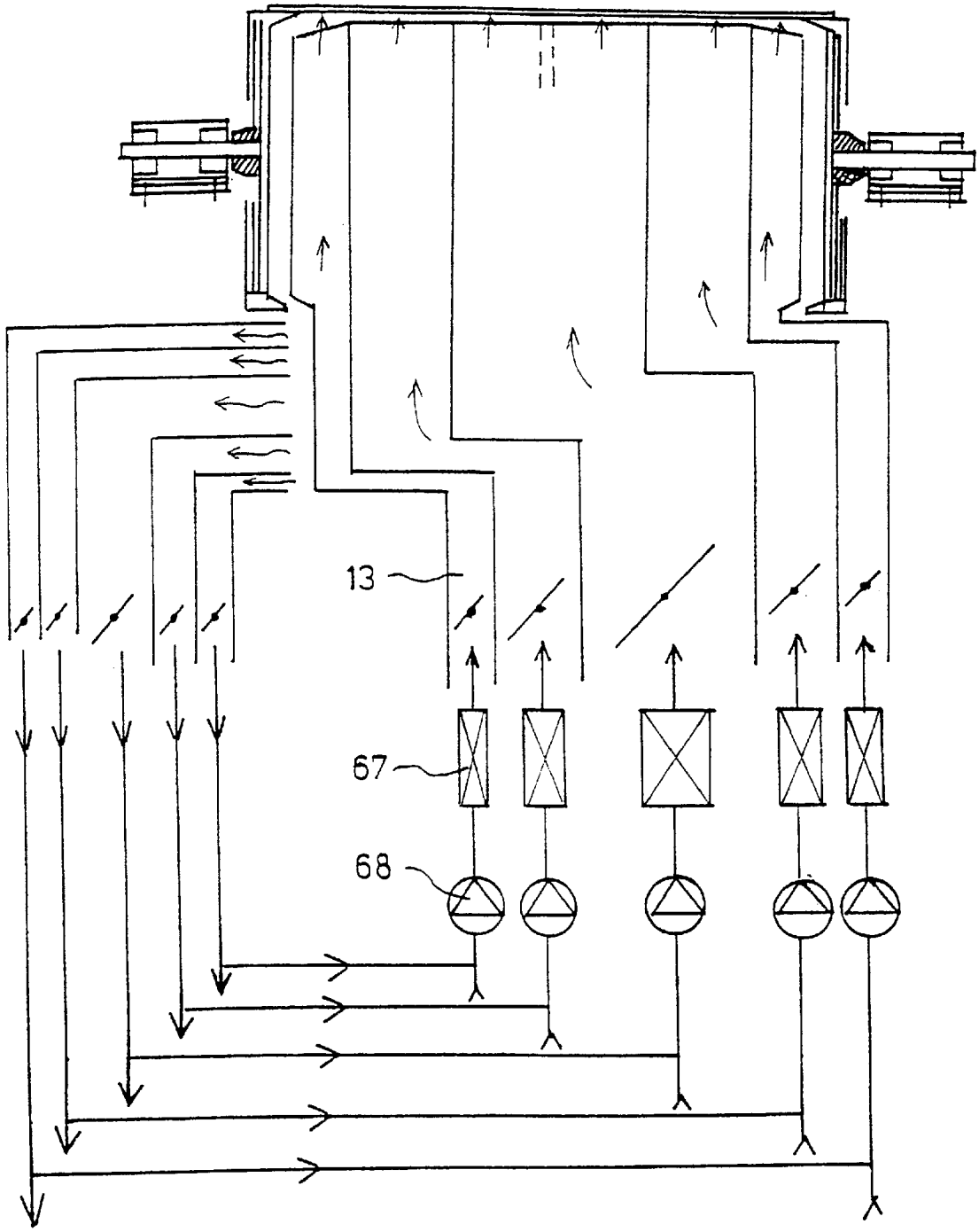

FIG. 7B is a schematic illustration of an exemplifying embodiment including separate temperature and blow pressure regulation in the cross-direction profile and/or longitudinal segment division of the blow drum 10. The blow device 10 is partitioned into discrete cross-direction or axial sections, each extending over a portion of the longitudinal axis of the blow device. In this embodiment, each air intake pipe 13 is provided with a heat source 67 of its own and with a blower 68 of its own. Each section may also have a dedicated exhaust duct 14. Each heat source and blower can be set to have the desired temperature and blow pressure parameters.

Figure 7C:
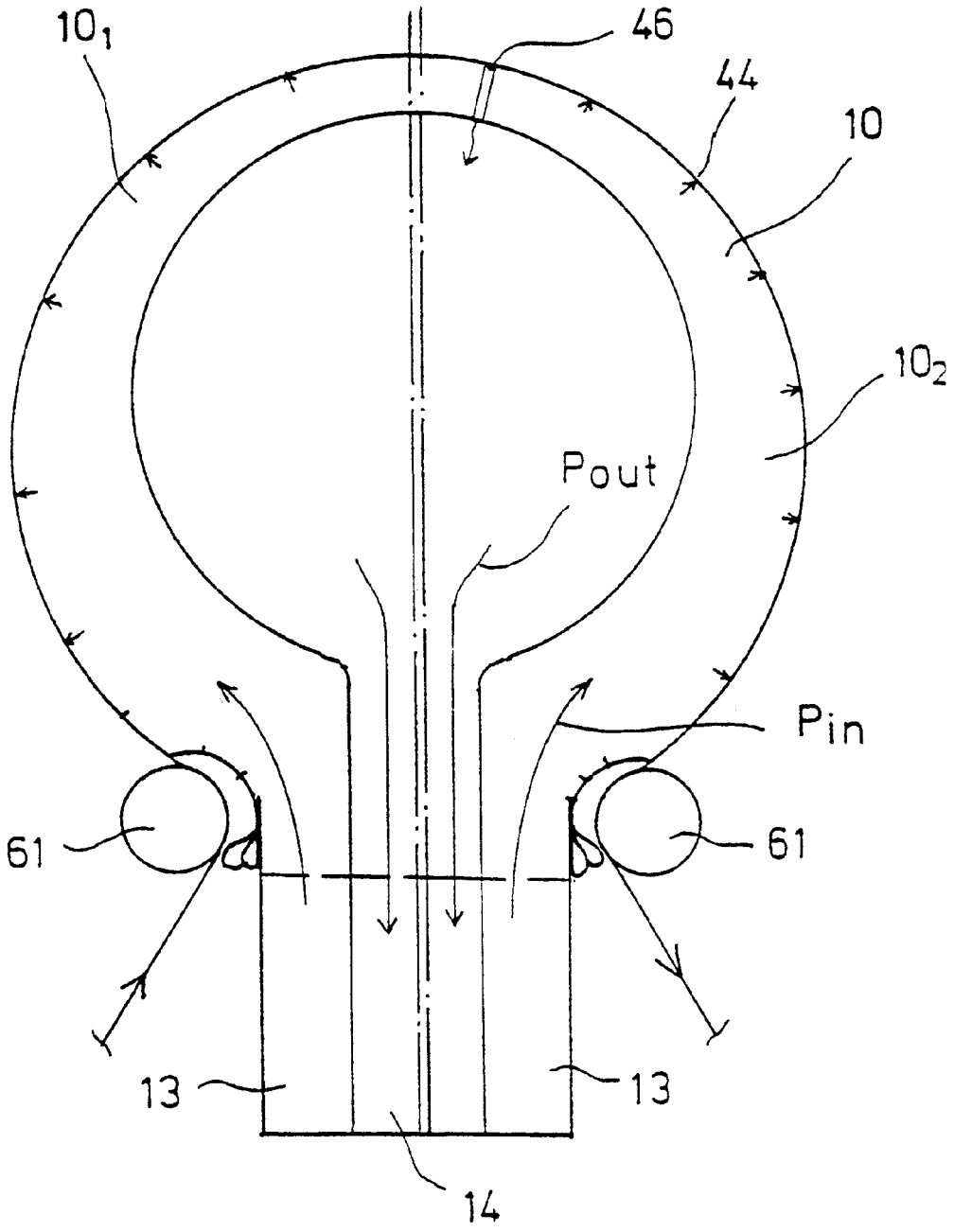
FIG. 7C schematically shows an arrangement in which a blow drum in accordance with the invention is divided into evaporation zones in the longitudinal direction of the web.

FIG. 7C shows division of the blow drum 10 into two segments 101,102 in the longitudinal direction of the web. In other words, the blow drum 10 is partitioned into a plurality of discrete sections in a longitudinal, running direction of the web W. In this manner, different drying values can be used in the longitudinal direction of the web W by adjusting the drying values of the segments 101,102 as desired.

Figure 7D:
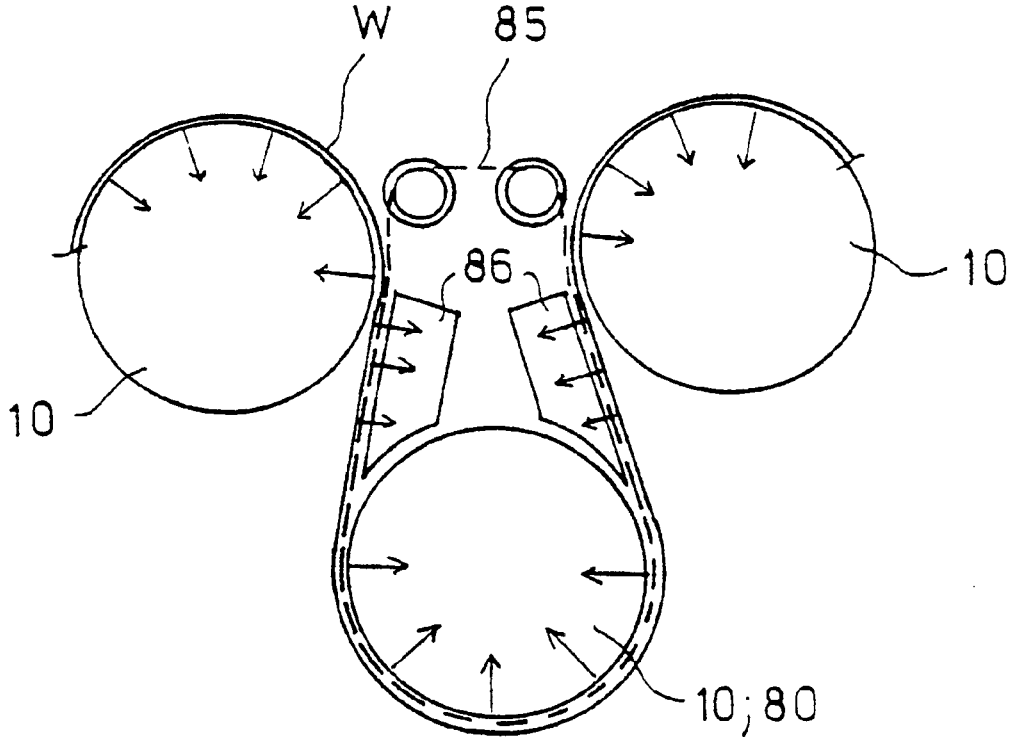
FIG. 7D schematically shows an arrangement connected with the hold of the edge when the web to be dried is passed from a drum onto a roll or from a drum onto a drum.

As shown in FIG. 7D, support bands 85 are used in the grip of the edge of the web W on a run from a drum 10 to a roll 80 or from a drum 10 to a drum 10. The band 85 is placed at each edge of the drum 10, the bands are pervious to air and robust that they hold the shrinkage force of the web W. The contact grip of the section supported by the band

85 is created by a separate vacuum device 86 which, when sealed against the band 85 and sucking through it, attaches the web W to the band 85.

Figure 8A:
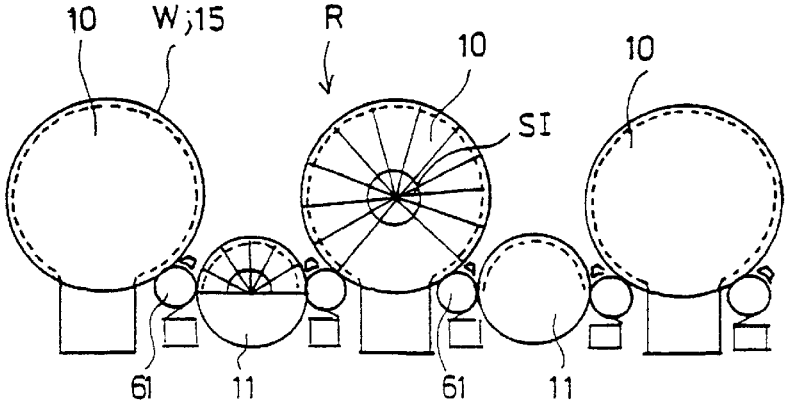
FIGS. 8A, 8B, 8C and 8D schematically show certain basic embodiments of dryer groups that can be provided by means of an arrangement in accordance with the invention.

FIG. 8A schematically shows a typical dryer group R with or without a wire provided with blow drums 10 in accordance with the invention, which dryer group comprises large blow drums 10 and small drums 11 between them. All blow drums 10,11 comprise suction sectors SI having an adjustable length of web contact. Between the drums 10,11 there are reversing rolls 61 whose edge zones are subjected to a vacuum.

Figure 8B:
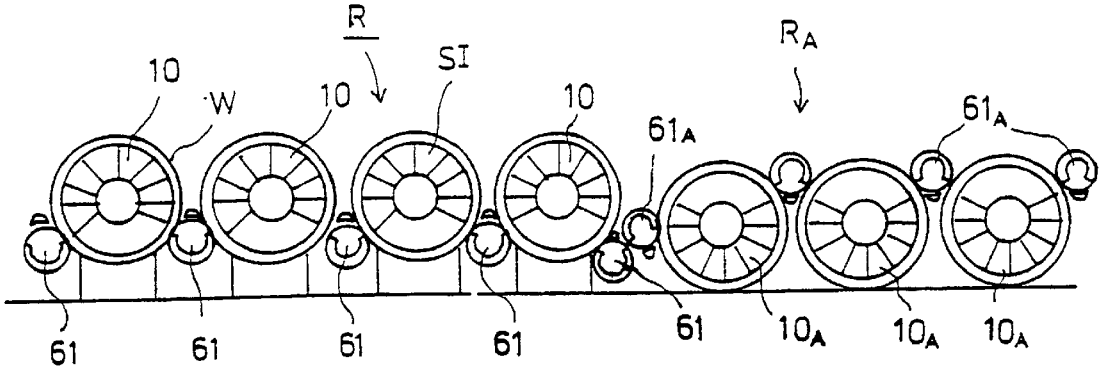
Figure 8C:
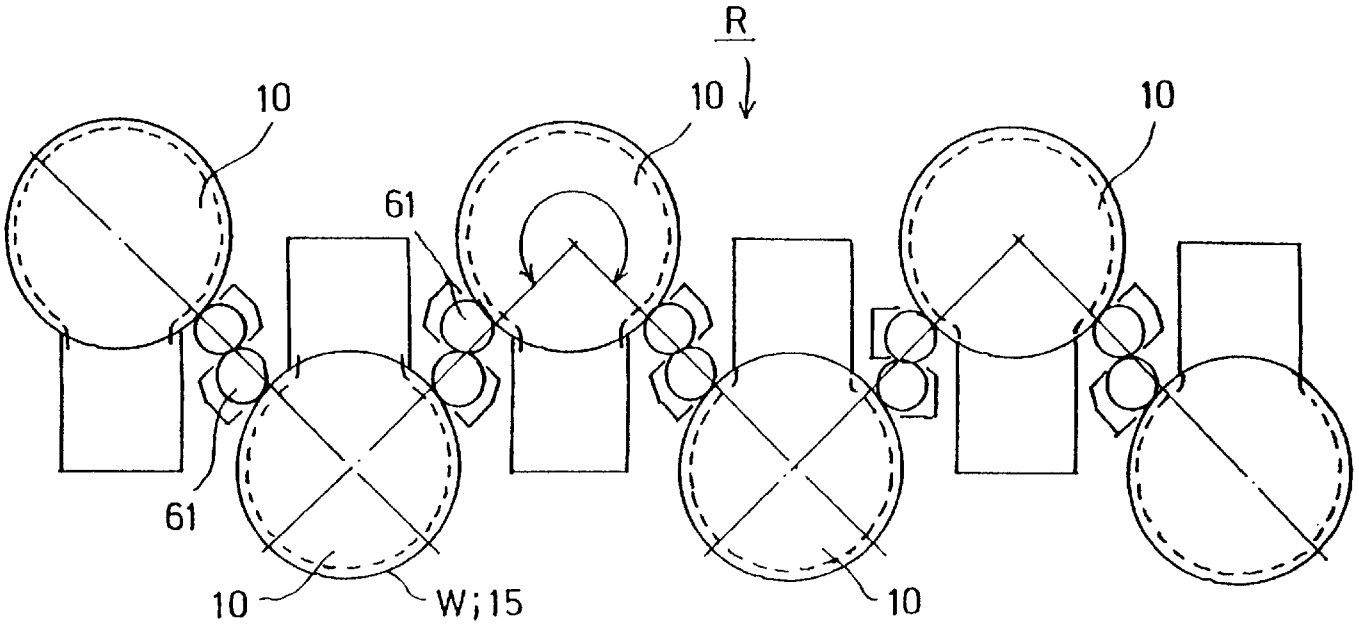

As shown in FIG. 8B, the dryer group R is composed of blow drums 10, in which dryer group, the web W to be dried runs over the blow drums 10 on the suction zones SI, guided by the reversing rolls 61. Thus, the group R shown in FIG. 8B mainly corresponds to the preceding one but the geometry is different. One-sided drying is eliminated by means of a so-called inverted group $R_A$ which is also composed of blow drums $\mathbf{10}_A$ in accordance with the invention, between which there are rolls or suction rolls $\mathbf{61}_A$. The draw with no wire meets the requirements imposed on an inverted group. In the group gap $R–R_A$, the web W is passed from the reversing roll 61 of the preceding group R straight onto the reversing roll $\mathbf{61}_A$ of the following group $R_A$ FIG. 8C schematically shows a dryer group R with or without a wire provided with blow drums 10 in accordance with the invention, in which group the web W to be dried runs supported from its edges by edge supports and guided by the drum and the rolls or by suction rolls 61 and so that both faces of the web W are altematingly turned toward the face of the drying drum 10.

Figure 8D:
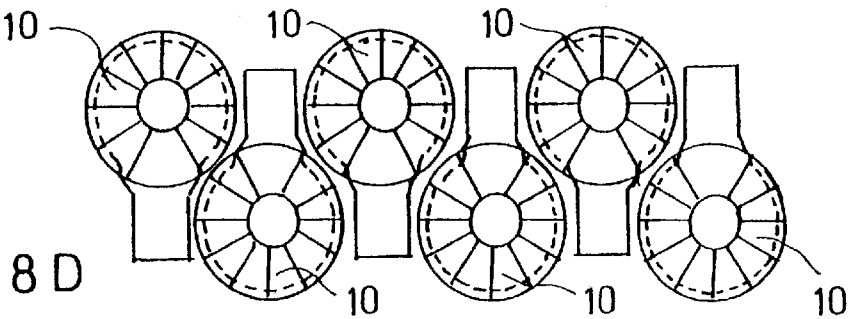

FIG. 8D shows an embodiment corresponding to the preceding one but without rolls. The web W runs directly from the drum 10 to the drum 10.

The examples provided above are not meant to be exclusive. Many other variations of the present invention would be obvious to those skilled in the art, and are contemplated to be within the scope of the appended claims. Thus, the invention has been described above only with reference to some of its advantageous embodiments. However, the invention is not intended to be narrowly confined to the disclosed embodiments. Numerous variations and modifications are possible within the scope of the inventive idea defined in the following claims.

I claim:

1. A method for one of drying and cooling a web, comprising the steps of:

passing the web over an arcuate circumference of a blow device, directing a gas from an interior of the blow device at the web through first openings formed in a mantle of the device to form a support zone between the mantle and the web, drawing moistened exhaust gas from the support zone into the interior of the blow device through second openings formed in the mantle of the device, arranging an edge support at each end of the blow device to support lateral areas of the web during the passage of the web over the circumference of the blow device, the edge supports being separate from the blow device, and constructing the edge supports with interior surfaces for laterally sealing the support zone.

2. The method of claim 1, wherein the blow device is a blow drum, further comprising the step of:

constructing the edge supports such that the web runs at a distance from an outer face of the mantle of the blow drum.

3. The method of claim 1, further comprising the step of:

adjusting the distance between the web and the mantle by regulating the ratio of the gas being directed through the first openings to the exhaust gas being drawn through the second openings.

4. The method of claim 1, further comprising the step of:

creating a vacuum in the area of the interior surfaces of the edge supports to increase the support of the lateral areas of the web on the edge supports.

5. The method of claim 1, further comprising the step of:

isolating the edge supports from the blow device by interposing isolation members between the edge supports and the blow device.

6. The method of claim 1, wherein the web is dried, further comprising the steps of:

partitioning the blow device into a plurality of discrete sections in a longitudinal, running direction of the web, and regulating the drying of the web in the longitudinal direction of the web by adjusting the properties of the gas in each of the longitudinal sections.

7. The method of claim 1, wherein the web is dried, further comprising the steps of:

partitioning the blow device into a plurality of discrete axial sections in a cross-direction of the web, and regulating a cross-direction profile of the web by adjusting the properties of the drying gas in each of the axial sections.

8. The method of claim 1, further comprising the step of:

controlling shrinkage of the web by adjusting the support of the lateral areas of the web provided by the edge supports.

9. The method of claim 1, further comprising the step of:

stretching the web in a cross direction by orienting the edge supports to open at an opening angle in a running direction of the web.

10. The method of claim 1, wherein the edge supports are constructed to revolve about an axis.

11. A device for one of drying and cooling a web, comprising an elongate blow device having a circumference over which the web is guided to run, said blow device having an intake duct arranged at least partially in an interior of said blow device, an exhaust duct arranged at least partially in the interior of said blow device, a mantle including first openings in flow communication with said intake duct and second openings in flow communication with said exhaust duct, an edge support arranged at each end of said blow device for supporting and guiding the web during the running of the web over the circumference of said blow device, said edge supports being separate from said blow device, and support means for supporting said blow device in a stationary position.

12. The device of claim 11, wherein said blow device includes an axle, said edge supports being arranged to revolve around said axle.

13. The device of claim 11, further comprising guide rolls arranged in connection with said blow device for guiding the web about said blow device and away from said blow device.

14. The device of claim 11, further comprising a duct system arranged in connection with said edge supports for producing a vacuum in an area of the circumference of said edge supports to increase adherence of the web to said edge supports.

15. The device of claim 10, wherein said blow device includes a plurality of separate sections arranged in a longitudinal, running direction of the web, each of said sections having a dedicated intake duct and a dedicated exhaust duct.

16. The device of claim 11, wherein said blow device is partitioned into a plurality of separate sections arranged in an axial direction of said blow device, each of said sections having a dedicated intake duct.

17. The device of claim 16, wherein each of said section has a dedicated exhaust duct, further comprising a plurality of heating devices, each associated with a respective one of said intake ducts for regulating the temperature of the gas being directed into the respective one of said sections such that a cross-direction profile of the web is regulatable.

18. The device of claim 11, further comprising means for cooling a circumference of said edge supports.

19. The device of claim 11, wherein said edge supports are arranged to be adjustable to open in a running direction of the web at an opening angle.

20. The device of claim 11, wherein the web is carried by a band around the arcuate circumference of said blow device, said edge supports each comprise a plurality of rolls arranged in an arc and at least one support band arranged to run around said rolls such that said at least one support band is interposed between said rolls and said band.

* * * * *